US006627827B2

(12) United States Patent
Kiong Low et al.

(10) Patent No.: US 6,627,827 B2
(45) Date of Patent: Sep. 30, 2003

(54) SWITCH, PARTICULARLY POSITION SWITCH, WITH A MULTI-DIRECTIONAL HEAD

(75) Inventors: Kok Kiong Low, Ruel-Malmaison (FR); Michel Rochard, Ruelle (FR); Didier Severac, Rueil-Malmaison (FR)

(73) Assignee: Schneider Electric Industries SAS (FR)

( * ) Notice: Subject to any disclaimer, the term of this patent is extended or adjusted under 35 U.S.C. 154(b) by 0 days.

(21) Appl. No.: 10/270,234

(22) Filed: Oct. 15, 2002

(65) Prior Publication Data

US 2003/0070906 A1 Apr. 17, 2003

(30) Foreign Application Priority Data

Oct. 15, 2001 (FR) ..... 01 13404

(51) Int. Cl.[7] ..... H01H 3/16
(52) U.S. Cl. ..... 200/47
(58) Field of Search ..... 200/17 R, 47, 200/61.41, 61.42, 334

(56) References Cited

U.S. PATENT DOCUMENTS 3,275,764 A * 9/1966 Kiessling et al. ..... 200/47
3,590,177 A 6/1971 Union et al. ..... 200/47
3,602,681 A * 8/1971 Finke ..... 200/339
3,699,283 A * 10/1972 Ustin ..... 200/47
4,133,991 A 1/1979 Takase ..... 200/47
4,847,453 A * 7/1989 Newell et al. ..... 200/47
5,028,748 A * 7/1991 Sakamoto ..... 200/47
5,276,299 A * 1/1994 Marsh ..... 200/570
5,894,116 A * 4/1999 Da Dalt ..... 200/43.04
5,929,404 A * 7/1999 Wecke et al. ..... 200/43.11

FOREIGN PATENT DOCUMENTS

FR 0 874 381 A2 9/1998 ..... H01H/21/28
FR 2 785 985 11/1998 ..... G01D/5/02

* cited by examiner

*Primary Examiner*—Michael Friedhofer
(74) *Attorney, Agent, or Firm*—Parkhurst & Wendel, L.L.P.

(57) ABSTRACT

A position switch whose box houses a switch assembly that can be maneuvered by an activation head holding a push button and located in a recess on one surface of the box so that it can be angularly adjusted at regular intervals. The head has a tubular bearing surface facing the box and in which a plunger slides for actuating the switch assembly. The bearing surface has notches at regular intervals for alignment with corresponding notches in the box recess. A lockable fork retains the head in position.

10 Claims, 3 Drawing Sheets

SWITCH, PARTICULARLY POSITION SWITCH, WITH A MULTI-DIRECTIONAL HEAD

BACKGROUND OF THE INVENTION

This invention concerns a switch, more specifically a position switch, comprising a box housing a device that can be moved in travel and an electric switch assembly activated by this device. Its manoeuvre head is fitted so that it is removable and angularly variable in a recess of the box, which opens out onto a fitting surface of the box. The manoeuvre head has a tubular bearing surface that houses a push button, directly or indirectly activated by an object, and able to slide along the travel axis to operate with the movable device.

It is often desirable to be able to adjust the position of the manoeuvre head of such a switch. Such adjustment may indeed be necessary if the switch is mounted in a predetermined position, while accepting activation by moving objects with varying trajectories.

In most examples of this type of position switch, see for example the U.S. Pat. No. 3,590,177 document, the head has a turning part that is moved by a lever and push button activated by the rotating part to operate with the movable device. The angular position of the head is adjusted by means of a costly rack-and-pinion device. There are also position switches whose push button is controlled by an axial activator; thus, document FR 2 785 985 shows a position switch whose head can be angularly adjusted using an indexing coupling and a positioning washer.

It is also known—see document IT 218 310—how to adjust the angular position of an idle position switch lever, by providing teeth in an axial recess of the lever or a part fixed to the lever and additional teeth on the bearing surface of the turning part of the head. However, this does not enable positive adjustment of the angular position of the head.

The invention aims to provide great flexibility of use for a switch in a very simple and compact way, particularly a position or safety switch, by positive angular adjustment of the manoeuvre head.

According to the invention, the tubular bearing surface of the manoeuvre head is equipped with external notches, placed at regular intervals,

- the outside of the box recess has internal notches, operating with the notches on the head, at the same intervals or at multiple intervals,
- the external and internal notches fit together according to the translation axis of the moveable device.

The tubular bearing surface may also provide a stop shoulder applicable to the fitting surface, with the external notches of the tubular bearing surface below the shoulder and radially set back from it. The internal notches of the recess can be formed by a moulded toothed crown, located at the opening of the recess or added within the recess.

A fork used to fix the head axially and confirm engaging of the notches can be included in a slot of the box to operate with an annular groove on the tubular bearing surface of the head. The fork can be held in its fixture position by various holding means, particularly a lock. Marks provided on the branch of the manoeuvre head, which is directed along the translation axis, and on the upper fitting surface on the edge of the recess enable easy viewing of the angular position of the head.

The invention also concerns a pivoting lever position switch, offering double angular adjustment of the head in relation to the box, and of a pivoting manoeuvre lever in relation to the head. In this case, the head is an L-shape, with the two branches equipped with regularly spaced notches, the head being mounted by its first branch in the respective notches provided at regular intervals around the outside of the recess, the lever being mounted on the second branch of the head and having respective notches at regular intervals.

The description given below is of a non-limiting production method of the invention, supported by the attached drawings.

DETAILED DESCRIPTION

Figure 1:
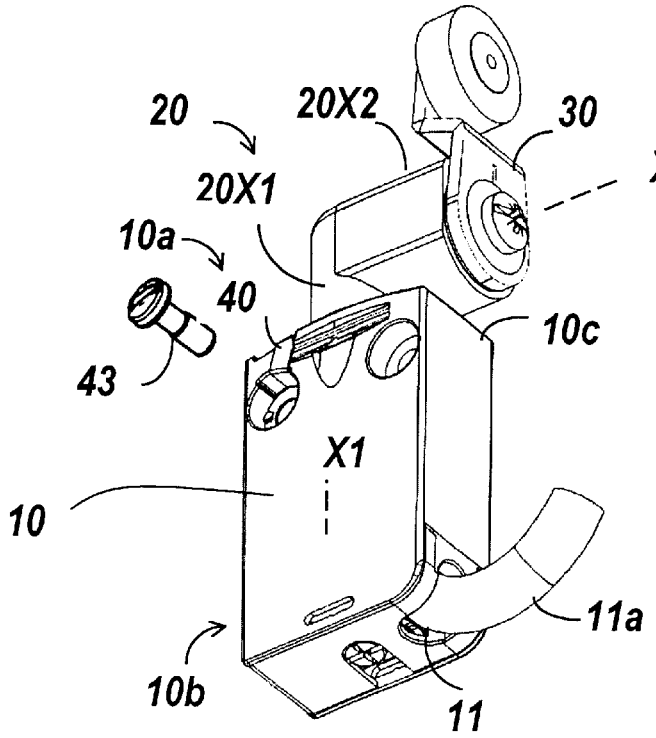
FIG. 1 shows a perspective drawing of the position switch according to the invention.

The position switch comprises a box 10, equipped in its top part 10*a* with a manoeuvre head 20 and in its bottom part 10*b*, with a cabling connector 11. The overall box is approximately parallelepiped and comprises a body that is closed by a front cover, and houses an electric switch assembly 12, to which the connector 11 is connected. A device 13 is mounted so that it can move in travel in the box, along axis X1 to activate the switch assembly 12 in response to movement of a lever 30 mounted to rotate on the head 20 around an axis X2 perpendicular to X1.

It should be noted that the cabling connector 11 is placed so that it is removable and interchangeable in a corner of the bottom part 10*b* of the box, so that different types of connection and orientations of the cable 11*a* are possible.

The overall manoeuvre head 20 is L-shaped with one branch 20X2, along axis X2, housing a turning part 21 with a cam 22 (see FIG. 3) and with the other branch 20X1, along axis X1 perpendicular to X2, having a push button 23 activated in the down direction by the cam 22 of part 21 and in the upward direction by a return spring 24. At its bottom end, the branch 20X1 of the manoeuvre head 20 narrows down to a tubular bearing surface 25, which fits into a recess 14 (see FIG. 4), opening out on a more or less flat surface 10*c* located in the top part 10*a* of the box. The bearing surface 25 has an annular groove 26 and a seal 27 to ensure tight mounting of the head in the recess 14. It also has an annular stop shoulder 25*a*, which pushes against the upper surface 10*c* of the box, this surface being flat or slightly curved. The shoulder pushes against the edge of the recess 14.

A fork 15 operates with the annular groove 26. The fork forms a key that prevents extraction of the head in direction X1. The fork 15 is inserted from the front F into a slot 16 provided on the front of the box (see FIG. 6). The fork is shown on FIG. 1 in the position where the head 20 is blocked and on FIG. 2 in the position where the head is free (the head can then be extracted along X1). It is pushed as shown by arrow F to move from its free position to its blocked position.

Figure 5:
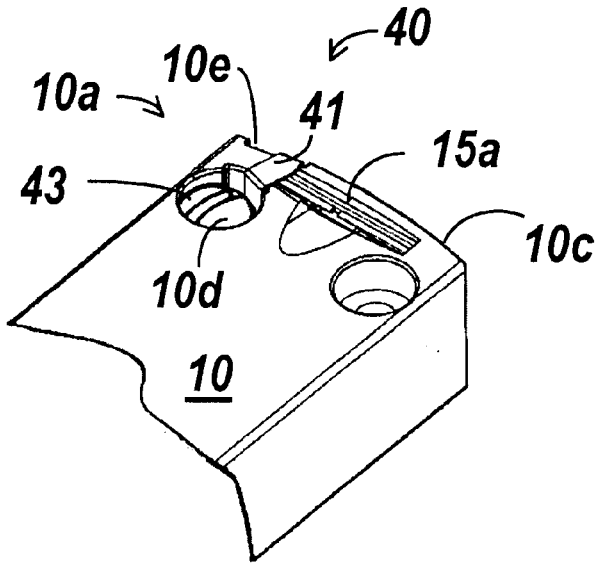
FIGS. 5 and 6 show the manoeuvre head blocking fork in the locked and unlocked positions respectively.

In its blocked position, the fork 15 can be locked by a pivoting lock 40. The lock 40 is shown on FIG. 6, out of the box, to simplify comprehension. The lock 40 has a blocking tab 41 applicable against the apparent edge 15*a* of the fork to block it; the lock also has an eyelet or a lug 42 fixed to the tab 41. The eyelet 42 is housed in a cylindrical housing 10*d* in the box 10 so that it can pivot around the housing axis and can be locked in position by a screw 43 whose head fits in the housing 10*d*. Incidentally, the use of the screw to fix the box on a support (not shown) is well known. The lock 40 is a simple cut and folded metal part and is practically flush to the edge of the box, apart from the thickness of its plate, to enable easy manoeuvre. The lock pivots around the axis of the indentation to pass from its unlocked position (FIGS. 2 and 6) to its locked position (FIGS. 1 and 5) and vice versa. Lock movement is guided by operation of a claw 44, provided on a right-angled extension of the tab 41, with a split 10*e* in the top part 10*a* of the box.

Figure 3:
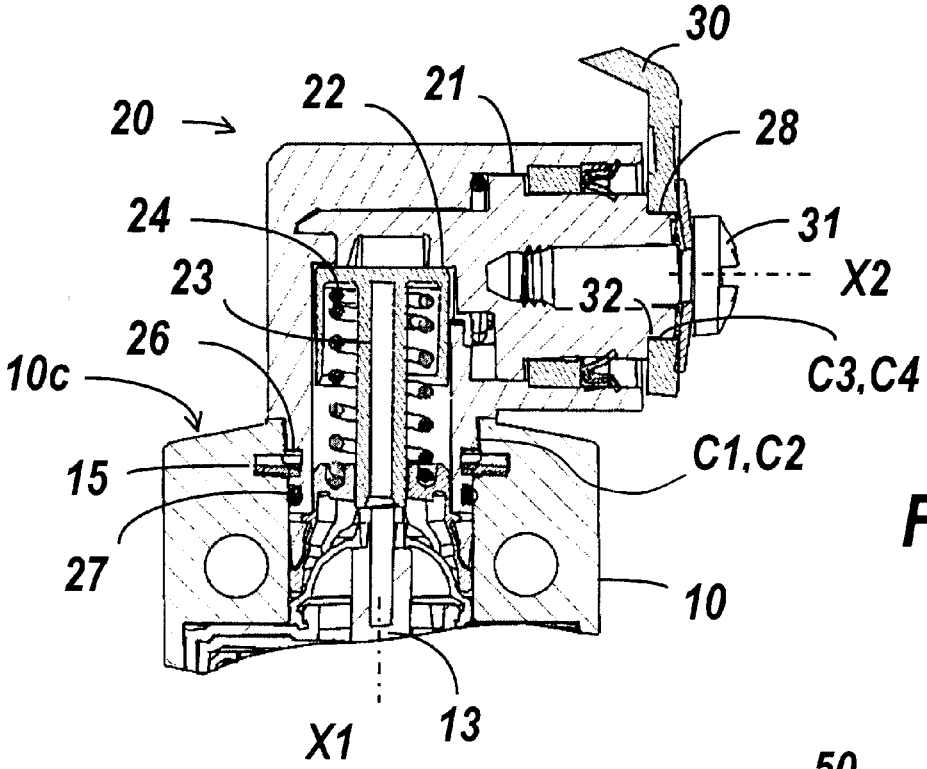
FIG. 3 is a cross-sectional view of the top part of the switch.

The branch 20X1 of the manoeuvre head 20 can be fitted around its outside with external notches or teeth C1 placed at small and regular intervals to enable fine adjustment of the angular position of the head. The notches can then connect with a small number of additional internal notches C2 (such as four), but with the same interval, or a multiple interval, on part of the circular sector of the opening of the recess 14. The notches have a small radial extension and their meshing is by engagement in direction X1. It is preferable that a small number of C1 notches are provided (for example, two groups of four notches, opposite at 180°) on the connector 25, while notches C2 are provided in a ring all around the edge of the recess 14 at the immediate opening of this recess on the surface. As shown in FIG. 3, the notches C1 are set back from the external template of the branch 20X1 of the head. It is also possible to provide only a few C2 notches and C1 notches around the whole periphery of the connector 25. The interval is, for example, 15°.

The lever 30 usually has at its free end, a roller 30*a* against which the object manoeuvring the switch comes to a stop. It is fixed by a screw 31 along axis X2 to the turning part 21. The lever 30 has a hole 32 along axis X2 so that it engages on a cylindrical bearing surface 28 of the turning part 21 so that it is angularly adjustable using indexing notches. For this purpose, around the edge of hole 32, near part 21, the lever 30 has internal notches C3 spaced out at regular intervals, equal to the intervals of notches C1, C2 or different from this interval, and part 21 has external notches C4 of the same interval as the C3 notches or of multiple interval, on bearing surface 28. The lever 30 and the bearing surface 28 are made of resistant materials so that the teeth C3,C4 can withstand the forces transmitted by the lever.

Marks M1,M2 are provided on the head and on the upper surface 10*c* of the box to indicate the angular position of the head in relation to the box; marks can be provided on the lever and the turning part to indicate the angular position of the idle lever.

Figure 4:
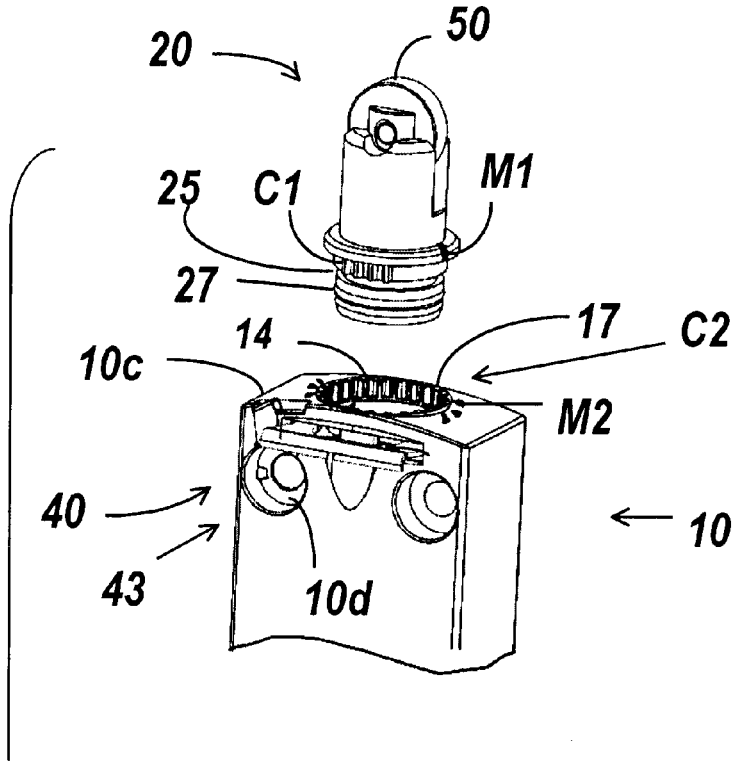
FIG. 4 shows a perspective view of the top part of a production variation of the switch.

In the production variation shown in FIG. 4, the head of the position switch does not have a lever, but just a push button 50, with a small number of notches C1 (for example, four) at the top of its tubular connector 25, while the recess 14 of the box 10 has a ring of C2 notches around its perimeter 17 near its opening and on the inside. It is advantageous to make the ring during box moulding, but it can also be added in the recess 14.

Figure 2:
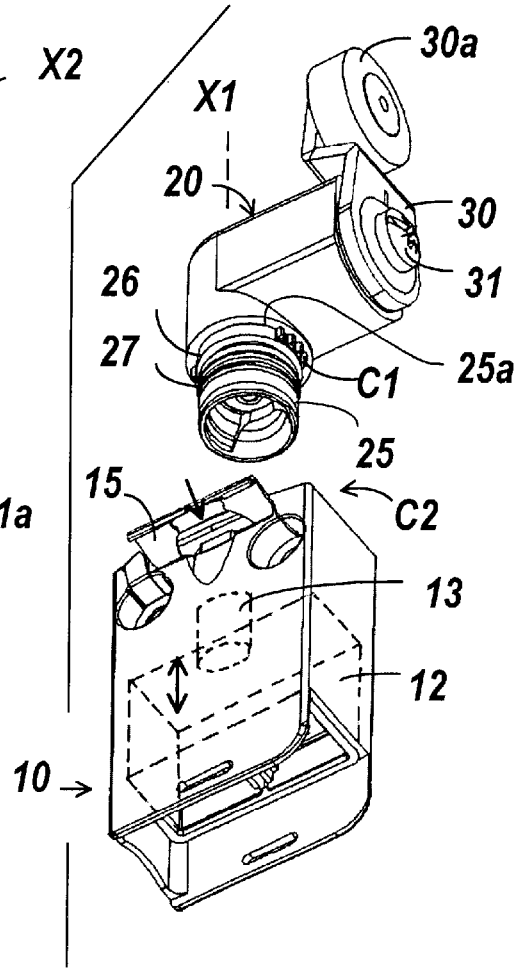
FIG. 2 shows a perspective exploded view on a larger scale of the switch in FIG. 1.
Figure 6:
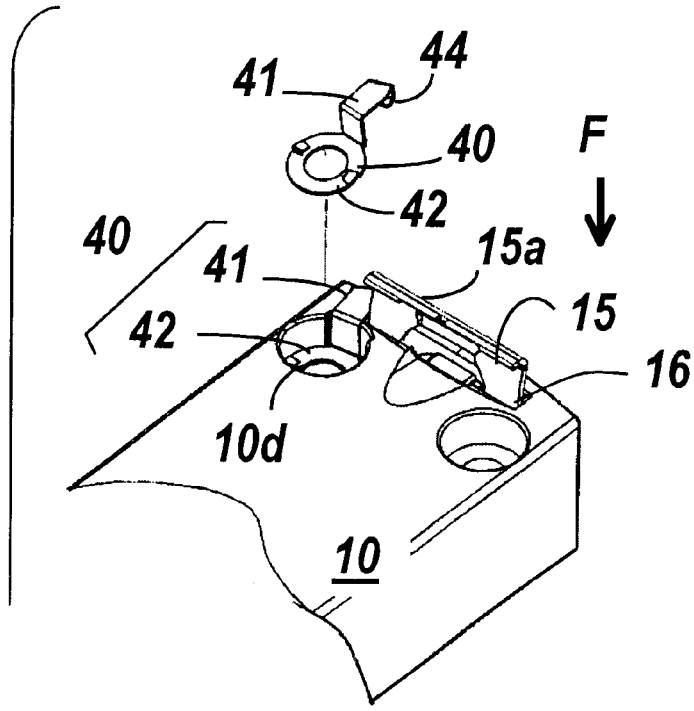

Adjustment is easy by releasing the lock 40, then taking out the fork to bring it to the position indicated in FIGS. 2,4,6, extraction of the head along X1 to disengage the notches C1,C2, placing of the head in the angular position required, pushing the head in along X1 until the notches C1,C2 are engaged and the shoulder 25*a* comes to a stop against the tubular bearing surface 25 on the surface 10*c* of the box. It should be noted that no screws are required to fix and hold the head in the desired angular position. Adjustment is simplified by the presence of a small number of notches C1 and the marks M1,M2.

What is claimed is:

1. A limit switch, comprising a box, containing a device movable along a translation axis and an electric switch assembly, activated by the movable device, a maneuver head removably mounted for angularly variable movement in a recess of the box, said recess opening onto a mounting surface of the box, the head having a tubular bearing surface that houses a push button for activation by an object, and able to slide along the translation axis to operate with the movable device, wherein:

the tubular bearing surface of the maneuver head has external notches spaced at regular intervals, the recess of the box has a periphery and internal notches located on said periphery and cooperating with the external notches of the head and located at an interval identical to the interval of the head notches, and the external notches and the internal notches fit together along the translation axis of the movable device.

2. The limit switch according to claim 1, wherein the box further comprises a mounting surface, and the tubular bearing surface has a stop shoulder applicable against the box mounting surface, and the external notches of the tubular bearing surface are located below the stop shoulder and radially set back from said stop shoulder.

3. The limit switch according to claim 2, further comprising a toothed ring integral with the box and located at the opening of the recess, said toothed ring comprising said internal notches of the recess of the box.

4. The limit switch according to claim 1, further comprising a fork, wherein the box has a slot and the tubular bearing has an annular groove, and the fork is for axially locating the head and ensuring engagement of the external and internal notches, the fork located in the slot of the box for cooperation with the annular groove on the tubular bearing surface of the head.

5. The limit switch according to claim 4, further comprising a lock, wherein the fork has an edge and is held in a fixing position by the lock, said lock comprising a blocking tab applicable against the edge of the fork and an eyelet held by a box fixing screw.

6. The limit switch according to claim 1, wherein the maneuver head has a branch extending along the translation axis and indices are located on said branch and on the mounting surface of the box near the recess.

7. The limit switch according to claim 1, further comprising a pivoting part and a fixing device, wherein the pivoting part has first indexing notches located on a surface, the maneuver head comprising a movement transfer head on which an activation lever is mounted for operating the push button by means of the pivoting part for rotation around a pivoting axis perpendicular to the translation axis, the lever being adjustably fixed to the pivoting part by the fixing device, said lever having second indexing notches in rotation for cooperating with said first indexing notches located at regular intervals on a surface of the pivoting part.

8. The limit switch according to claim 7, wherein the first indexing notches are located at multiple intervals on a surface of the turning part.

9. The limit switch according to claim 1, wherein the internal notches of the recess of the box are located at a multiple of the interval of the head notches.

10. A limit switch, comprising a box containing a device movable along a translation axis, an electric switch assembly activated by the device, an L-shaped maneuver head comprising two branches removably attached to the box, head having a push button activated by an object via a pivoting lever for rotation around a pivoting axis perpendicular to the translation axis and operating with the movable device, first means for angular adjustment of the head relative to the box, and second means for angular adjustment of the pivoting lever relative to to the head, the first means for angular adjustment further comprising external notches of the head located at regular intervals on the first branch and internal notches located in the box, the external notches of the head and the internal notches of the box cooperating along the translation axis, and the second means for angular adjustment further comprising first indexing notches located at regular intervals on the second branch and second indexing notches located on the pivoting lever, the first indexing notches of the second branch and the second indexing notches of the pivoting lever cooperating along the pivoting axis.

* * * * *